US007829810B2

(12) United States Patent
Nakajima

(10) Patent No.: US 7,829,810 B2
(45) Date of Patent: Nov. 9, 2010

(54) PUSHBUTTON SWITCH COVER SHEET

(75) Inventor: Daisuke Nakajima, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 9 days.

(21) Appl. No.: 12/078,104

(22) Filed: Mar. 27, 2008

(65) Prior Publication Data

US 2008/0185273 A1 Aug. 7, 2008

Related U.S. Application Data

(62) Division of application No. 11/363,930, filed on Mar. 1, 2006, now abandoned.

(30) Foreign Application Priority Data

Mar. 4, 2005 (JP) ..... 2005-061370

(51) Int. Cl.
*H01H 13/04* (2006.01)
*H01H 19/04* (2006.01)

(52) U.S. Cl. ..... 200/333; 200/512

(58) Field of Classification Search ..... 200/333
See application file for complete search history.

(56) References Cited

U.S. PATENT DOCUMENTS

| | | | | |
|---|---|---|---|---|
| 4,293,754 | A | 10/1981 | Komaki | |
| 4,680,724 | A | 7/1987 | Sugiyama et al. | |
| 4,771,139 | A * | 9/1988 | DeSmet | 200/5 A |
| 6,899,598 | B2 | 5/2005 | Prasad | |
| 7,034,235 | B2 | 4/2006 | Hosaka | |
| 7,070,349 | B2 | 7/2006 | Dombrowski et al. | |
| 7,119,296 | B1 | 10/2006 | Lui et al. | |
| 2004/0211656 | A1 | 10/2004 | Kunthady et al. | |

FOREIGN PATENT DOCUMENTS

| | | |
|---|---|---|
| GB | 2 132 028 A | 6/1984 |
| JP | 62 115616 A | 5/1987 |
| JP | 2003-197063 | 7/2003 |
| JP | 2004-313857 | 11/2004 |

OTHER PUBLICATIONS

Communication from European Patent Office for application No. # 06003879.1-2214 dated Sep. 19, 2007.
Office Action from Chinese Patent App. No. 2006100547305 (Apr. 3, 2009).

* cited by examiner

*Primary Examiner*—Michael A Friedhofer
*Assistant Examiner*—Lheiren Mae A Caroc
(74) *Attorney, Agent, or Firm*—Cermak Nakajima LLP; Tomoko Nakajima

(57) ABSTRACT

The present invention provides a pushbutton switch cover sheet formed by using a thin metal plate, in which damage or deformation, such as bending or denting, of the thin metal plate is prevented, thereby making it possible to continuously maintain a satisfactory design. The pushbutton switch cover sheet comprising: a plurality of display portions; a plurality of depressing-operation portions for effecting key input on the display portions, respectively; a base sheet formed of a rubber-like elastic material; and a thin metal plate provided on the base sheet, wherein a reinforcing member formed of a polymeric material is provided for each depressing-operation portion so as to be adjacent to the thin metal plate in a direction of a thickness of the thin metal plate.

20 Claims, 13 Drawing Sheets

PUSHBUTTON SWITCH COVER SHEET

CROSS REFERENCE TO RELATED APPLICATIONS

The present application is a Divisional Application of the patent application Ser. No. 11/363,930, filed Mar. 1, 2006, which is based on the priority application JP-2005-061370 filed on Mar. 4, 2005, the entire contents of which are incorporated herein by reference.

BACKGROUND OF THE INVENTION

1. Field of the Invention

This invention relates to a pushbutton switch cover sheet for the key depressing-operation portion of an apparatus, such as a mobile phone, a personal digital assistant (PDA), a car navigation apparatus, or a car audio apparatus.

2. Description of the Related Art

Regarding electronic/electric apparatuses for personal use, a reduction in size and thickness has progressed. Not only is there diversification in function as electronic/electric apparatuses, but also diversification in design is under way. To say nothing of the design of the casing of a mobile phone, there is tough competition in terms of design to achieve product differentiation also regarding a pushbutton switch cover member forming the surface portion of a portable phone. For example, JP 2003-197063 A discloses a resin key top in which a large number of metal foil pieces are laminated on the surface of the resin key top to form a specular gloss layer, thereby attaining a metallic tone. Further, Japanese patent application No. 2004-313857 discloses a pushbutton switch cover sheet using a single thin metal plate. As shown in FIGS. 12 and 13, a pushbutton switch cover sheet (101) as disclosed in Japanese patent application No. 2004-313857 has a structure in which a thin metal plate (102) formed of a single metal plate is firmly attached to a base sheet (103) formed of a rubber-like elastic material, and in which tongue-shaped dividing grooves (104) are formed in the thin metal plate (102) having display portions (105), allowing depression-displacement of each display portion (105).

The pushbutton switch cover sheet (101) disclosed in Japanese patent application No. 2004-313857, in which the key input operating surface is formed by the thin metal plate (102), provides a novel design. However, the thickness of the thin metal plate (102) is as small as 50 μm to 300 μm, which is to be regarded as a problem. That is, in performing key input operation, when a key is depressed with a sharp object such as a fingernail tip or with an excessive force, the surface may be damaged or dented, or the periphery of the dividing grooves (104) or of the display portions (105) may suffer deformation, such as bending.

SUMMARY OF THE INVENTION

The present invention has been made in view of the above problem in the prior art. The present invention provides a pushbutton switch cover sheet (hereinafter also referred to as "cover sheet") formed by using a thin metal plate, in which damage or deformation, such as bending or denting, of the thin metal plate is prevented, thereby making it possible to continuously maintain a satisfactory design.

The present invention provides a pushbutton switch cover sheet including: a plurality of display portions; a plurality of depressing-operation portions for effecting key input on the display portions, respectively; a base sheet formed of a rubber-like elastic material; and a thin metal plate provided on the base sheet, characterized in that a reinforcing member formed of a polymeric material is provided for each depressing-operation portion so as to be adjacent to the thin metal plate in a direction of a thickness of the thin metal plate.

Since the thin metal plate is provided on the base sheet formed of a rubber-like elastic material, the pushbutton switch cover sheet is not distorted or deflected even if the apparatus casing is equipped with no dividing rails separating the depressing-operation portions from each other. Further, since the apparatus requires no dividing rails, it is possible to impart a novel design to the apparatus. Further, since the thickness of the thin metal plate is small, it is possible to achieve a reduction in the thickness of the apparatus as a whole. In the case of a so-called illumination type cover sheet in which illumination is effected through the display portions by an inner light source, such as a light-emitting diode (LED), provided in the apparatus, it is possible to provide a pushbutton switch cover sheet in which no light is transmitted through the thin metal plate, with illumination being effected with uniform, intense light through through-holes provided as the display portions.

Further, in the pushbutton switch cover sheet of the present invention, a reinforcing member formed of a polymeric material is provided for each depressing-operation portion so as to be adjacent to the thin metal plate in the direction of the thickness thereof, so even if depressing operation is performed with a sharp object, such as a fingernail tip, or with an excessively large force, the surface of the thin metal plate does not suffer damage or deformation, such as denting or bending. Further, the surface of the thin metal plate is protected and free from contamination or oxidation, thus making it possible to provide a pushbutton switch cover sheet always exhibiting a metallic gloss.

Further, it is possible to provide a pushbutton switch cover sheet in which the thin metal plate has dividing sections defining the depressing-operation portions, and in which the dividing sections are formed as U-shaped sections defining the depressing-operation portions so as to allow swinging in the direction of the thickness of the thin metal plate and as dividing holes extending through the thin metal plate. Since the thin metal plate has dividing sections defining the depressing-operation portions, and the dividing sections are formed as U-shaped sections defining the depressing-operation portions so as to allow swinging in the direction of the thickness of the thin metal plate and as dividing holes extending through the thin metal plate, when the depressing-operation portions are depressed, up-and-down swinging is possible around portions where there are no U-shaped dividing sections, so it is possible to reduce the ON-load at the time of depressing operation, thus making it possible to provide a pushbutton switch cover sheet that is superior in operability.

Since the depressing-operation portions provided on the thin metal plate are defined into a U-shaped configuration by the dividing sections, it is possible to create depressing-operation portions of various configurations according to the way the U-shaped dividing sections are combined. Thus, it is possible to provide a variety in design. For example, it is possible to provide depressing-operation portions divided in opposite directions by a dividing section so as to be adjacent to each other.

Further, it is also possible to provide a pushbutton switch cover sheet in which the thin metal plate has dividing sections defining the depressing-operation portions and in which the dividing sections are formed as half-through dividing grooves not extending through the thin metal plate. Since the thin metal plate has dividing sections defining the depressing-operation portions, and the dividing sections are formed as half-through dividing grooves not extending through the thin metal plate, there is no danger of a finger entering a dividing section to be injured thereby. Further, since the thin metal plate retains the configuration of a single plate, deformation, such as denting or bending, does not easily occur. Further, the dividing sections can be formed by an easy working process.

By using a thin metal plate allowing deflection of a depressed portion at the time of depressing operation, it is also possible to modify the dividing sections such that they are formed by lines drawn on the thin metal plate in printing ink. Further, by providing contacts directly under the display portions, it is possible to omit the dividing sections.

According to the present invention, it is also possible to provide a pushbutton switch cover sheet in which a transparent reinforcing member is provided on the upper surface of the thin metal plate. Since the reinforcing member is transparent and is provided on the upper surface of the thin metal plate, there is no fear of the thin metal plate being directly damaged even if depression is effected with a sharp object, such as a fingernail tip. Further, since the thin metal plate is reinforced by the reinforcing member, there is no fear of the thin metal plate being dented or bent.

Further, according to the present invention, it is also possible to provide a pushbutton switch cover sheet in which the reinforcing member is provided on the lower surface of the thin metal plate. Since the reinforcing member is provided on the lower surface of the thin metal plate, it is possible to reinforce the thin metal plate from the lower surface thereof. A thin metal plate reinforced from the lower surface thereof by a reinforcing member is not easily damaged even if the upper surface thereof is depressed with a fingernail tip or the like. Further, the thin metal plate does not easily suffer deformation, such as denting or bending.

The thickness of the reinforcing member may range from 0.2 mm to 2.0 mm. Since the thickness of the reinforcing member may range from 0.2 mm to 2.0 mm, it is possible to meet the requirement for a reduction in thickness while reinforcing the thin metal plate. In the case of a pushbutton switch cover sheet in which reinforcing members are provided on the upper and lower surfaces of the thin metal plate, the thickness of the reinforcing member is the sum total of the thickness of the reinforcing member formed on the upper surface and the thickness of the reinforcing member formed on the lower surface.

Further, in the pushbutton switch cover sheet of the present invention, it is possible to provide a display portion for each depressing-operation portion. Here, the display portion is a portion indicating a character, a symbol, a figure or the like. By providing a display portion for each depressing-operation portion, it is possible to perform separate input for each of the characters, symbols, figures or the like indicated by the display portions. The formation of the display portions can be effected by stamping simultaneously with the formation of the dividing holes.

The pushbutton switch cover sheet of the present invention has a novel design not to be found in conventional pushbutton switch cover members, and helps to attain a reduction in the weight, size, and thickness of the apparatus on which the pushbutton switch cover sheet is mounted. In the case of an illumination type cover sheet, a satisfactory light guiding property is attained, and it is possible to effect uniform illumination from a desired position.

Further, the pushbutton switch cover sheet of the present invention is a cover sheet whose thin metal plate does not easily suffer surface damage or deformation, such as denting or bending.

The above description of the present invention should not be construed restrictively; the advantages, features, and uses of the present invention will become still more apparent from the following description given with reference to the accompanying drawings. Further, it should be understood that all appropriate modifications made without departing from the gist of the present invention are covered by the scope of the present invention.

DETAILED DESCRIPTION OF THE PREFERRED EMBODIMENTS

Figure 1:
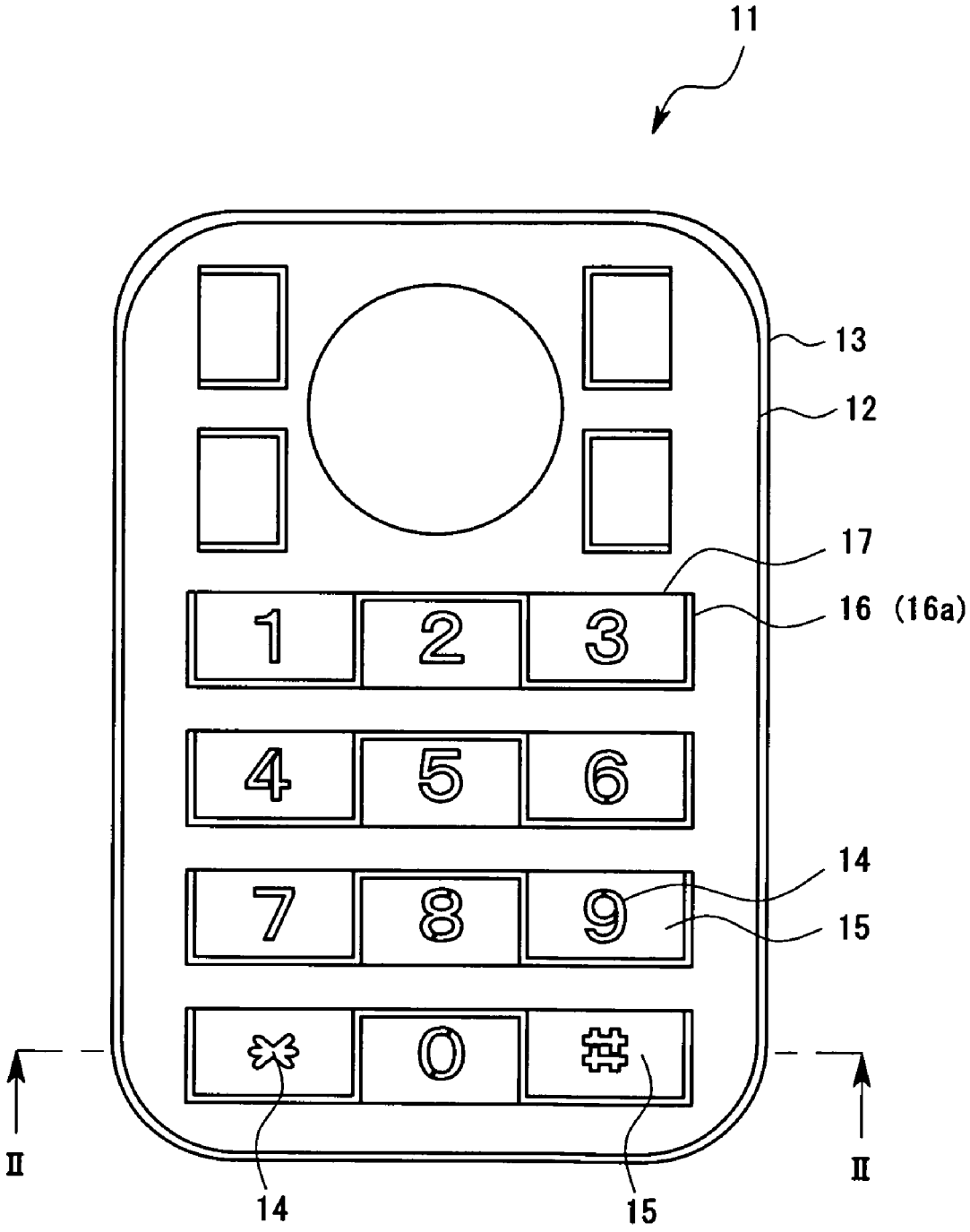
FIG. 1 is a plan view of a pushbutton switch cover sheet (cover sheet) according to a first embodiment of the present invention.

In the following, embodiments of the present invention will be described with reference to the drawings. Throughout the drawing, like reference numerals will be understood to refer to like parts and components. Regarding the structure and materials common to the following embodiments, a redundant description thereof will be omitted. In the following description, the "apparatus" may be an electronic device. This electronic device may include a mobile phone, a PDA, a remote controller, a car navigation apparatus, a car audio apparatus, or any other device having a keypad or pushbutton switch cover sheet.

First Embodiment

Figure 2:
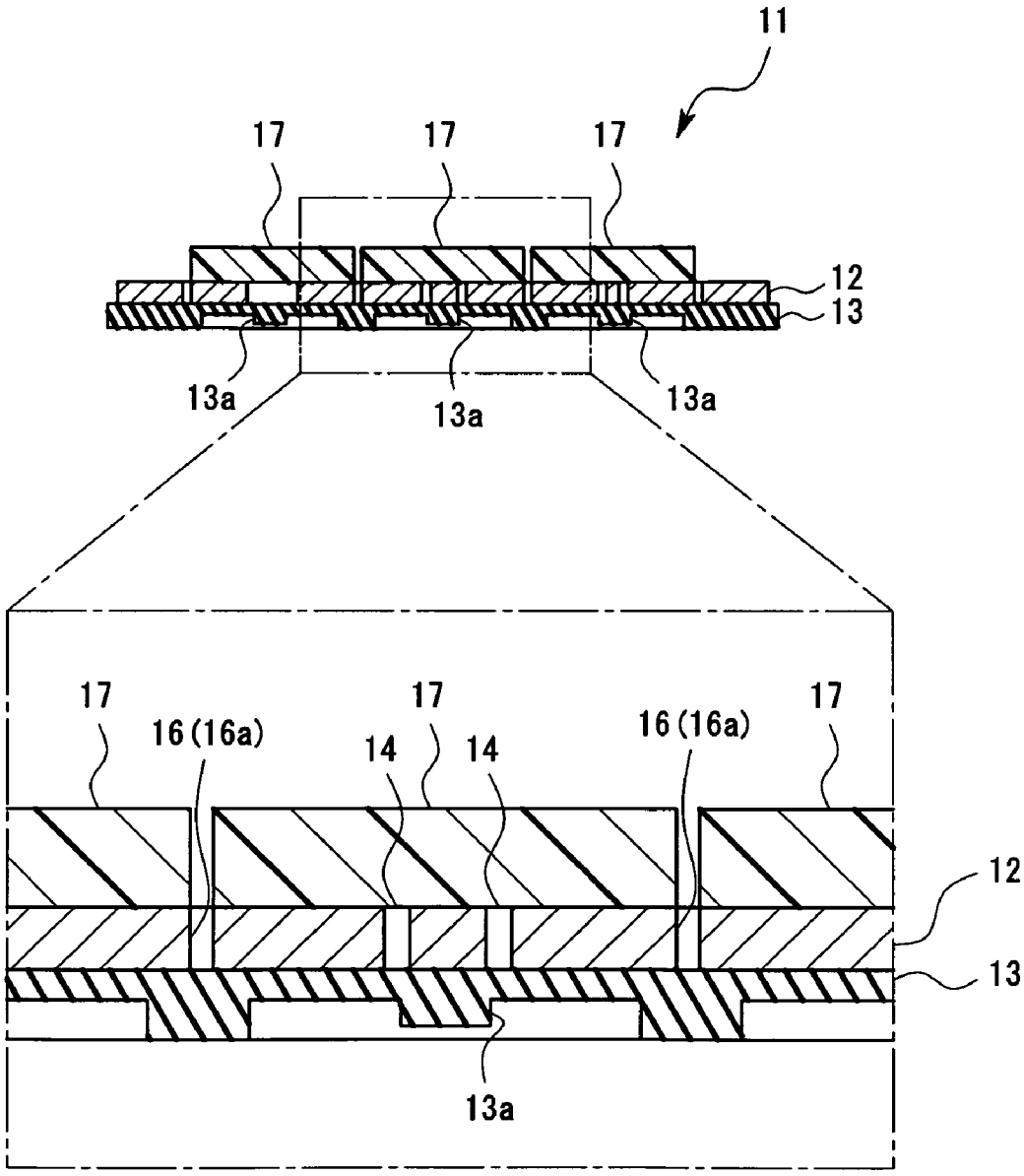
FIG. 2 is a sectional view taken along the line II-II of FIG. 1.

FIGS. 1 and 2

A pushbutton switch cover sheet (11) according to a first embodiment of the present invention is formed by using an adhesive or the like to bond a thin metal plate (12) with the upper surface of a base sheet (13), the base sheet (13) being formed of a rubber-like elastic material. On the surface of the thin metal plate (12), there are provided a plurality of display portions (14) indicating characters, symbols, or other indicia, and dividing sections (16) in the form of dividing holes (16*a*) extending through the thin metal plate (12) and dividing the surface of the thin metal plate (12) into tongue-shaped portions, are provided so as to form depressing-operation portions (15) for effecting key input for the individual display portions (14), respectively. On the thin metal plate (12), there are provided a plurality of reinforcing members (17) formed of a transparent resin material and arranged in correspondence with the individual depressing-operation portions (15) to cover the thin metal plate (12). Side surfaces of the reinforcing members (17) are flush with the dividing sections (16), the dividing sections (16) extending through the thin metal plate (12). When the pushbutton switch cover sheet (11) is incorporated into the electronic device, depressing the depressing-operation portions (15) may depress contacts on a printed circuit board (not shown) provided under the pushbutton switch cover sheet (11), thereby making it possible to effect key input.

The thin metal plate (12) may be formed of a metal plate. This metal plate can be made of stainless steel or the like. The thickness of the thin metal plate (12) may range from 50 μm to 2000 μm. More preferably, the thickness of thin metal plate (12) may range from 50 μm to 300 μm. When the thickness of the thin metal plate (12) is less than 50 μm, the rigidity of the thin metal plate (12) is rather low, and it is difficult to suppress distortion of the pushbutton switch cover sheet (11). On the other hand, when the thickness of thin metal plate (12) exceeds 2000 μm, not only it is difficult to meet the requirement for a reduction in the thickness of the apparatus, but also a large load is required for input operation, and no tactile feel can be obtained. Further, the formation of the dividing holes (16*a*) extending through the thin metal plate (12) and the display portions (14) becomes difficult. The thickness range of 50 μm to 300 μm may be preferable since, when the thickness exceeds 300 μm, it becomes somewhat difficult to perform the working process to form the dividing holes (16*a*) and the display portions (14) so as to cause the dividing holes 16*a* and the display portions (14) to extend through the thin metal plate (12). Furthermore, this thickness range from 50 μm to 2000 μm helps to meet a number of requirements, such as a reduction in apparatus thickness, the requisite rigidity of the thin metal plate (12), and depression-operability.

In forming the thin metal plate (12), the dividing holes (16*a*) and the display portions (14) may be formed by photo etching or the like. The display portions (14) need not extend through the thin metal plate (12). However, in the case of an illumination type cover sheet (11), through which illumination is effected through the display portions (14), the display portions (14) are formed as through-holes constituting light paths.

Regarding the reinforcing members (17) provided on the thin metal plate (12), their thickness preferably ranges from 0.2 mm to 2.0 mm so that the reinforcing members (17) may prevent damage and deformation of the thin metal plate (12), and meet the requirement for a reduction in the thickness of the apparatus. There are no particular limitations regarding the type of polymeric material forming the reinforcing members (17). In this regard, the reinforcing members 17 may be, for example, a hard resin, a thermoplastic elastomer, or synthetic rubber. Since the thickness of the reinforcing members (17) is as small as 0.2 mm to 2.0 mm, it is desirable for the material of the reinforcing members (17) to be one having a bending modulus of not less than 70 MPa and a Shore D hardness of not less than 40 so that no deformation, such as bending or denting, may not occur upon depressing operation. It should be noted, however, when, as in this embodiment, the reinforcing members (17) are provided on the upper surface side of the thin metal plate (12), it is desirable to use a highly transparent and hard polymeric material, such as polymethyl metacrylate resin, polycarbonate resin, or polystyrene resin so as not to impair the design of the thin metal plate (12). As their name indicates, the reinforcing members (17) may be formed of thin and rectangular parallelepiped hard resin members, may be formed as the reinforcing members (17) obtained by stamping the portions corresponding to the dividing sections (16) from a film-shaped resin material, or may be formed as film-like reinforcing members (17) obtained by applying a liquid resin to the portions corresponding to the depressing-operation portions (15).

The base sheet (13) may be formed of a rubber-like elastic material. This rubber-like elastic material for the base sheet (13) may be silicone rubber or thermoplastic elastomer. Since the base sheet (13) formed of a rubber-like elastic material is provided on the lower surface of the thin metal plate (12), the thin metal plate (12) is not directly pressed against the printed circuit board but the base sheet (13) is brought into contact with the contacts on the printed circuit board. Thus, the printed circuit board can be made relatively free from damage. Further, since the base sheet (13) covers the lower surface of the thin metal plate (12), it is possible to prevent intrusion of water through the dividing holes (16*a*) and the display portions (14). The pushbutton switch cover sheet (11) may be formed of a transparent material when the pushbutton switch cover sheet (11) is to be formed as an illumination type cover sheet (11).

It is desirable for the base sheet (13) to have, at positions on the lower surface thereof below the depressing-operation portions (15), pushers (13*a*) for depressing the contacts. The pushers (13*a*) can reliably lead the depressing operation received by the depressing-operation portions (15) to conduction of the contacts, thereby making it possible to avoid a situation in which no input is effected although the depressing-operation portions (15) have been depressed.

In manufacturing the pushbutton switch cover sheet (11), the thin metal plate (12) is provided in a mold, and a thermoplastic transparent hard resin constituting the reinforcing members (17) and a thermoplastic elastomer constituting the base sheet (13) are injected into the mold for integral molding. The reinforcing members (17) and the base sheet (13) may be formed separately, and then bonded to the thin metal plate (12) by adhesive. Moreover, the reinforcing members (17) and the thin metal plate (12) may be fixed to each other through integral molding in which the material of the reinforcing members (17) is injected, and the thin metal plate (12) and the base sheet (13) are fixed to each other by adhesive.

In the pushbutton switch cover sheet (11) thus obtained, each of the reinforcing members (17) is separately formed for each depressing-operation portion (15), so no great load is required for depressing operation. Thus, as compared with the case in which there are no reinforcing members (17), no deterioration in operability is involved. Further, since the reinforcing members (17) are provided on the upper surfaces of the depressing-operation portions (15), there is no fear of the thin metal plate (12) suffering damage or deformation, such as bending or denting, even if depression is effected with a sharp object at the time of depressing operation. Thus, it is possible to provide a cover sheet (11) capable of maintaining a satisfactory design.

Second Embodiment

FIG. 3

Figure 3:
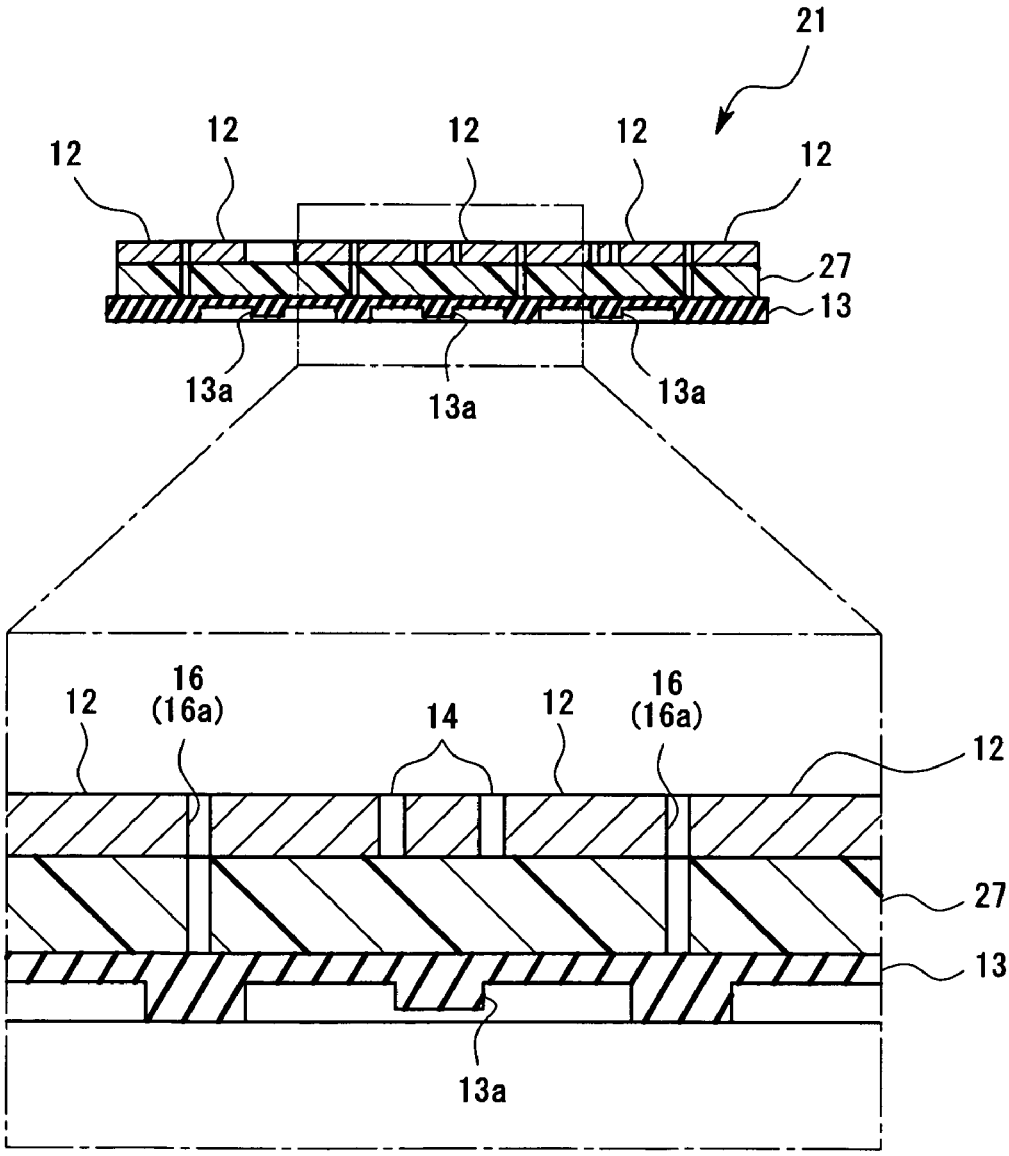
FIG. 3 is a sectional view, corresponding to FIG. 2, of a cover sheet according to a second embodiment of the present invention.

A pushbutton switch cover sheet (21) according to a second embodiment of the present invention differs from the pushbutton switch cover sheet (11) according to the first embodiment of the present invention in that reinforcing members (27) are provided on the lower surface of the thin metal plate (12). That is, as shown in FIG. 3, the reinforcing members (27) are provided between the thin metal plate (12) and the base sheet (13) formed of a rubber-like elastic material. Also in the production of the pushbutton switch cover sheet (21), as in the case of the pushbutton switch cover sheet (11) according to the first embodiment of the present invention, it is possible to firmly attach the thin metal plate (12), the reinforcing members (27), and the base sheet (13) to each other. The thin metal plate (12), the reinforcing members (27), and the base sheet (13) may be firmly attached to each other by injection integral molding. In addition, the thin metal plate (12), the reinforcing members (27), and the base sheet (13) may be firmly attached to each other by an adhesive. Other methods and processes used to firmly attach the thin metal plate (12), the reinforcing members (27), and the base sheet (13) to each other is also within the scope of the invention.

In the pushbutton switch cover sheet (21), the reinforcing members (27) reinforce the lower surface of the thin metal plate (12). Thus, the reinforcing members (27) do not directly protect the upper surface of the thin metal plate (12) on which input operation is conducted. However, since the thin metal plate (12) is reinforced from the lower surface and increases in rigidity, it is possible to make the surface of the thin metal plate (12) relatively free from damage or deformation, such as bending or denting.

Third Embodiment

FIG. 4

Figure 4:
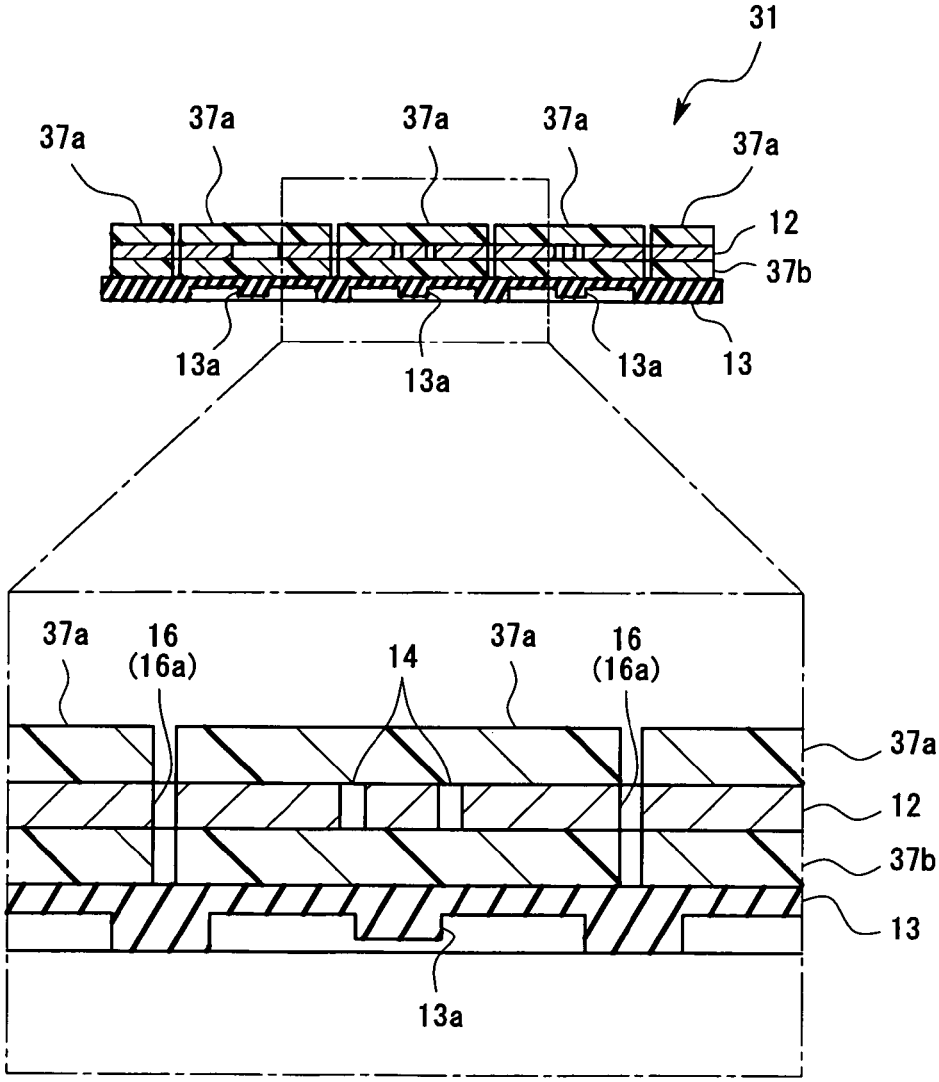
FIG. 4 is a sectional view, corresponding to FIG. 2, of a cover sheet according to a third embodiment of the present invention.

While in the pushbutton switch cover sheet (11) according to the first embodiment of the present invention the reinforcing members (17) are provided on the upper surface of the thin metal plate (12), and in the pushbutton switch cover sheet (21) according to the second embodiment of the present invention the reinforcing members (27) are provided on the lower surface of the thin metal plate (12), in a pushbutton switch cover sheet (31) according to a third embodiment of the present invention, reinforcing members (37*a* and 37*b*) are provided on the upper and lower surfaces of the thin metal plate (12), respectively, as shown in FIG. 4, with the thin metal plate (12) being sandwiched between the reinforcing members (37*a* and 37*b*).

The upper and lower reinforcing members (37*a* and 37*b*) may range from 0.1 mm to 1.0 mm. This range from 0.1 mm to 1.0 mm may permit the upper and lower reinforcing members 37*a* and 37*b* to meet the requirement for a reduction in apparatus thickness. Further, the reinforcing members (37*a*) provided on the upper surface of the thin metal plate (12) may be formed of a transparent resin material. In this regard, the display portions 14 may be visually recognized when the reinforcing members (37*a*) provided on the upper surface of the thin metal plate (12) is formed of a transparent resin material. In this way, the reinforcing members (37*a* and 37*b*) may be provided on the upper and lower surfaces of the thin metal plate (12). Providing the reinforcing members (37*a* and 37*b*) on the upper and lower surfaces of the thin metal plate (12) may reinforce the thin metal plate (12). Providing the reinforcing members (37*a* and 37*b*) on the upper and lower surfaces of the thin metal plate (12) may also prevent the thin metal plate 12 from suffering damage or undergoing deformation, such as bending and denting.

Modifications of the Embodiments

FIGS. 5 through 11

The pushbutton cover sheets (11, 21, and 31) of the present invention allow various modifications without departing from the objective of the invention. For example, the following modifications are possible.

Figure 5:
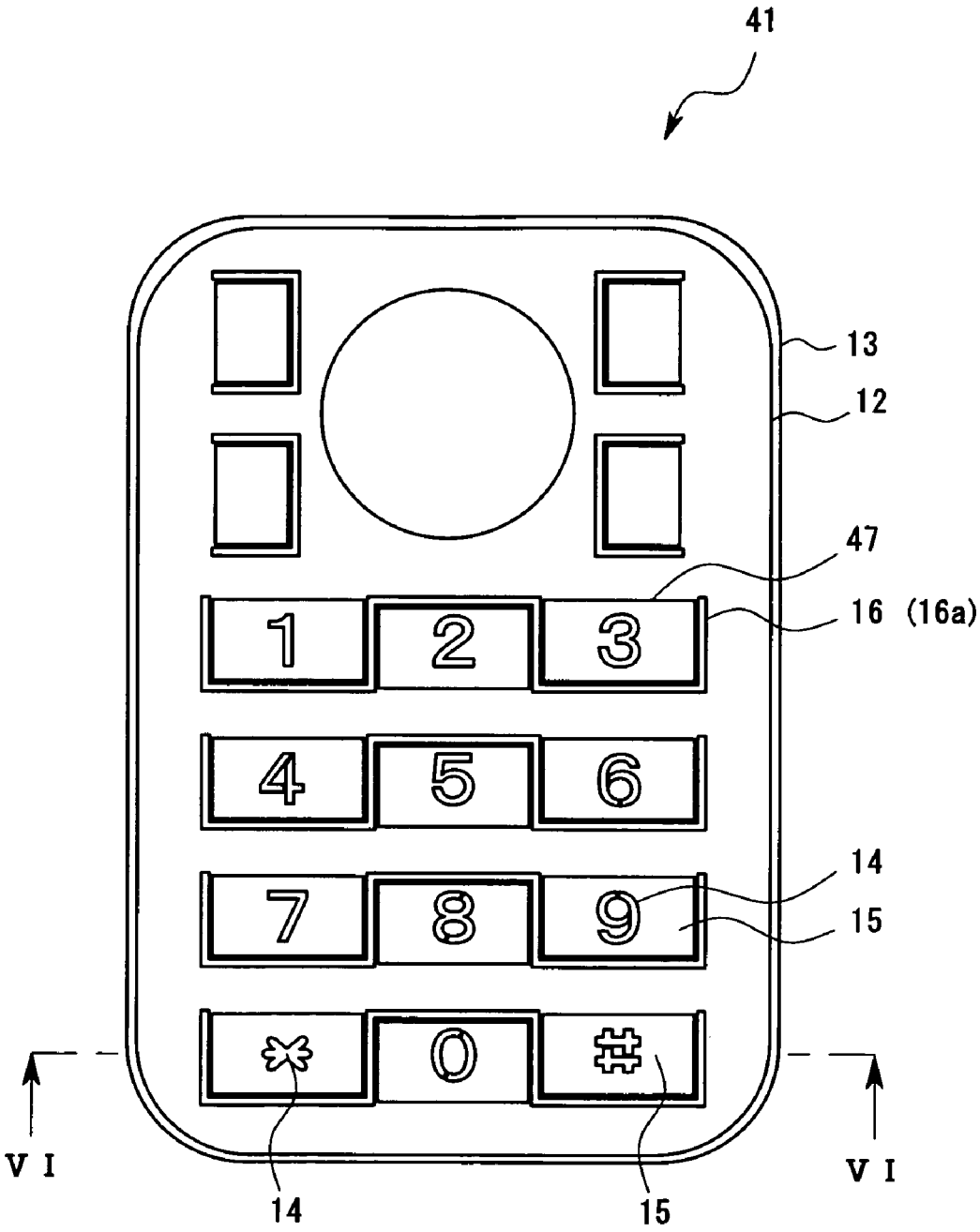
FIG. 5 is a plan view, corresponding to FIG. 1, of a modification of the pushbutton switch cover sheet according to the first embodiment of the present invention.
Figure 6:
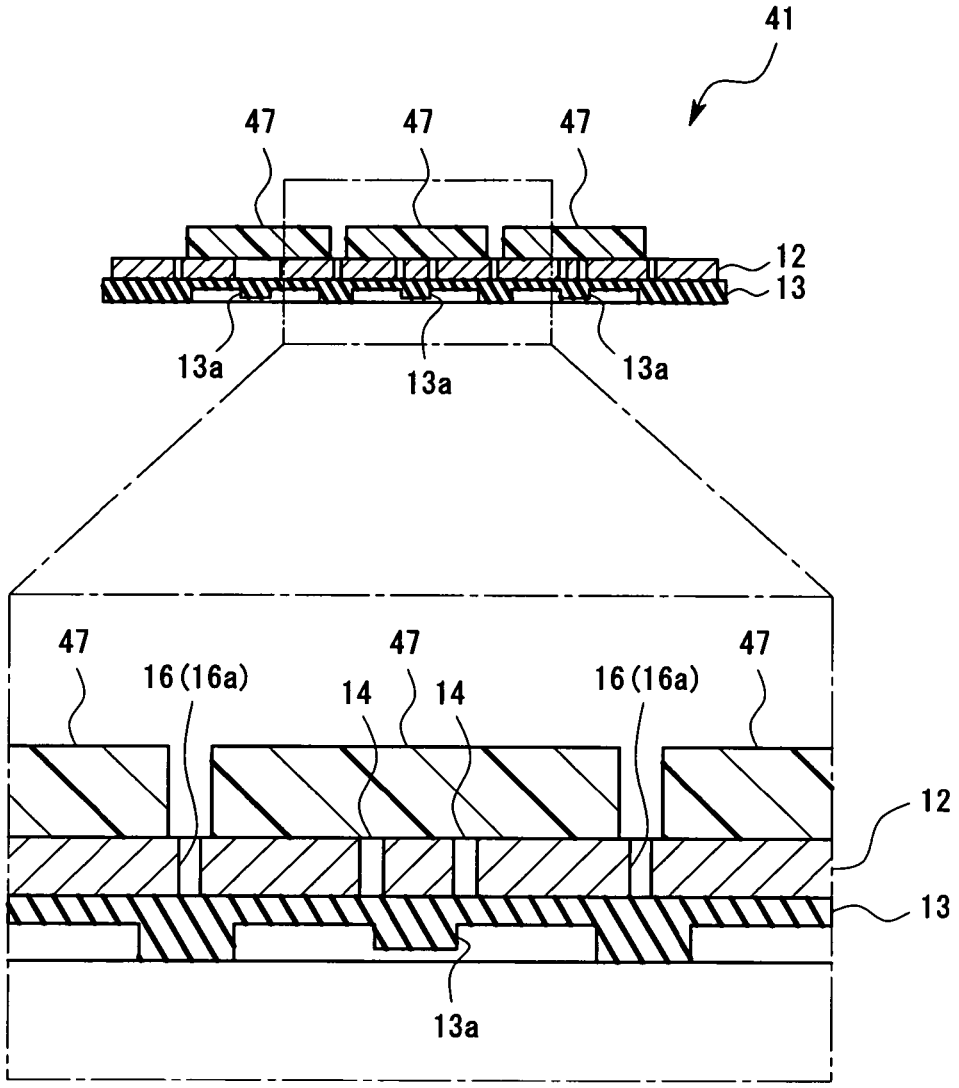
FIG. 6 is a sectional view of the pushbutton switch cover sheet taken along the line VI-VI of FIG. 5.
Figure 7:
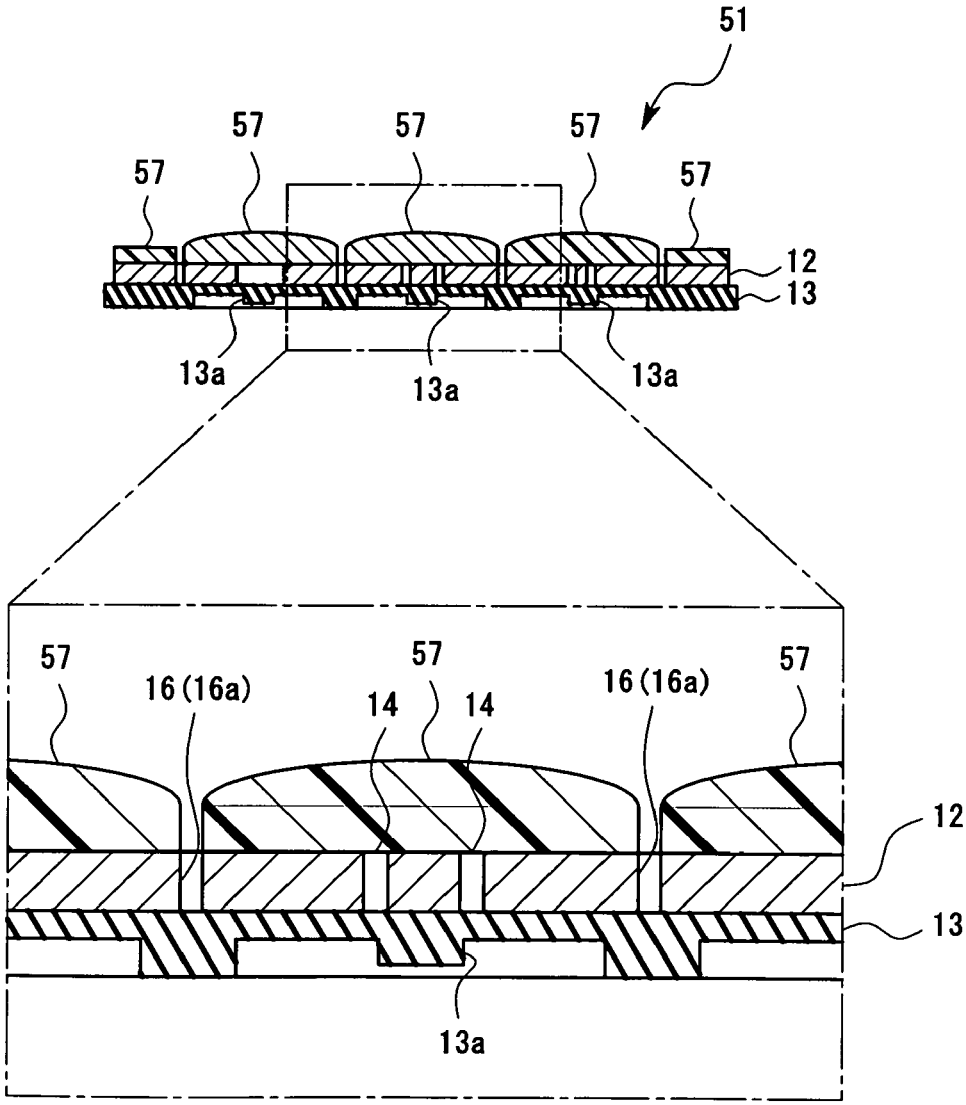
FIG. 7 is a sectional view, corresponding to FIG. 2, of another modification of the pushbutton switch cover sheet according to the first embodiment of the present invention.

The reinforcing members (17, 27, 37*a*, and 37*b*) may be provided mainly for the purpose of preventing deformation of the thin metal plate (12), as shown in FIGS. 5 and 6. The reinforcing members (47) associated with the pushbutton switch cover sheet (41) may be somewhat smaller than the depressing-operation portions (15) defined by the dividing sections (16). When the reinforcing members (47) are provided on the upper surface of the thin metal plate (12), as shown in FIG. 6, the reinforcing members (47) are spaced apart from each other to a degree that an object does not directly come into contact with the thin metal plate (12).

Figure 8:
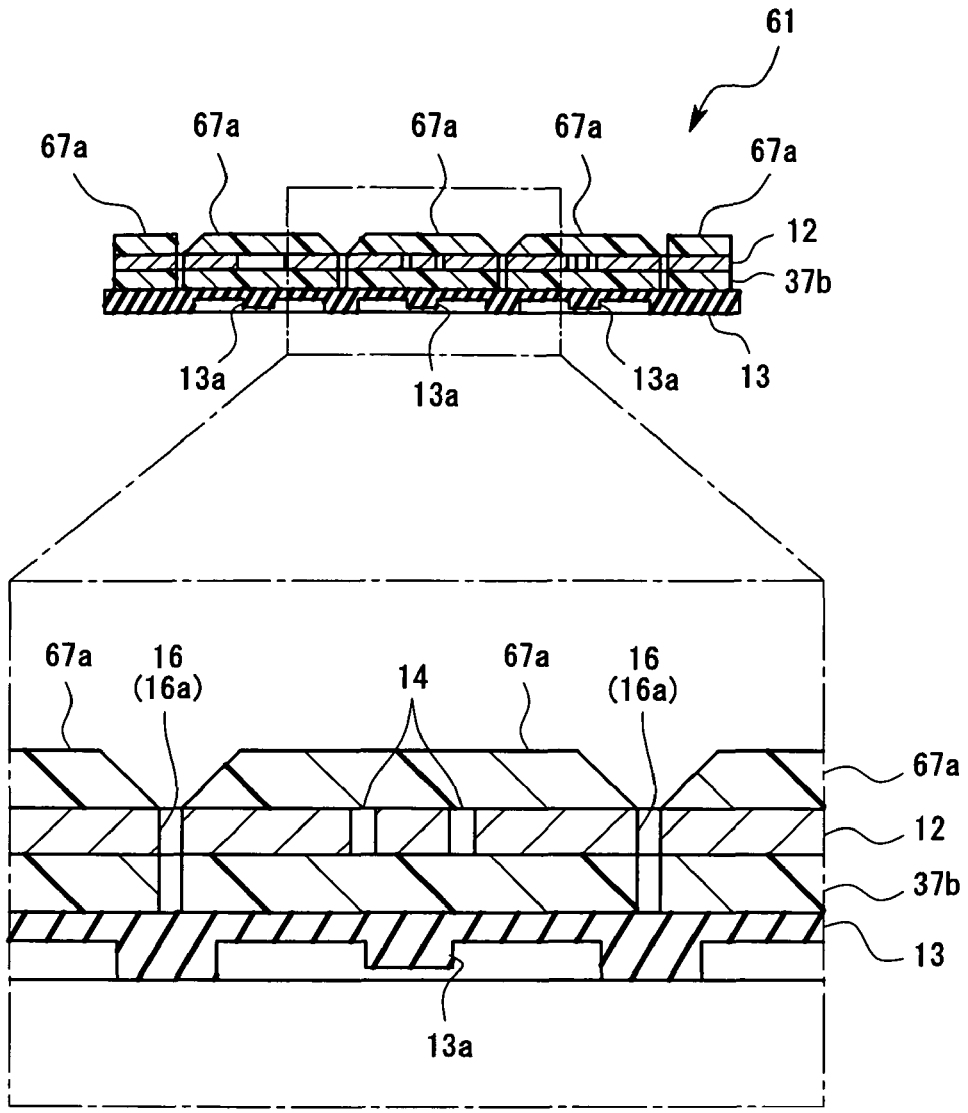
FIG. 8 is a sectional view, corresponding to FIG. 2, of a modification of the pushbutton switch cover sheet according to the third embodiment of the present invention.
Figure 9:
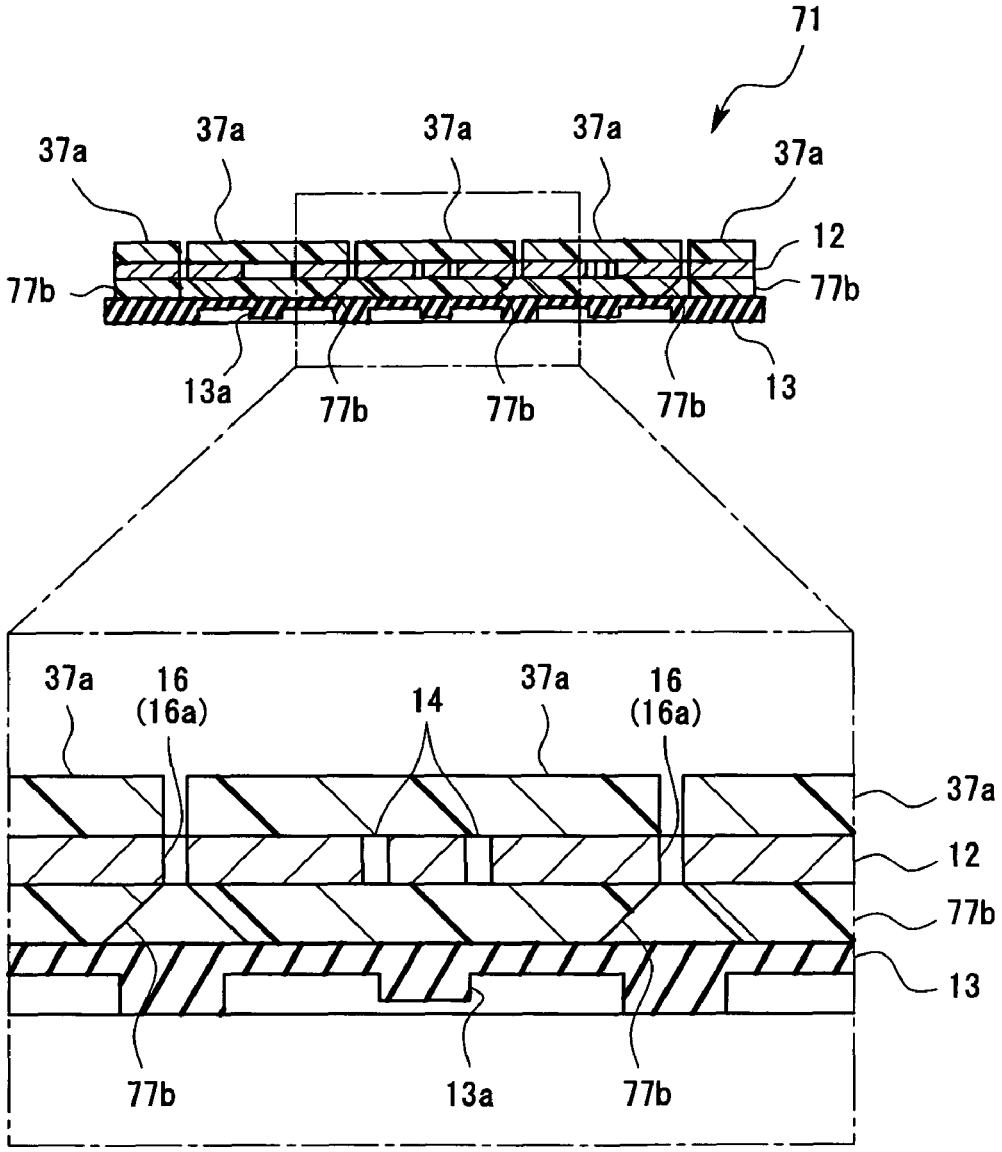
FIG. 9 is a sectional view, corresponding to FIG. 2, of another modification of the pushbutton switch cover sheet according to the third embodiment of the present invention.

There are no particular limitations regarding the configurations of the reinforcing members (17, 27, 37*a*, and 37*b*). For example, as a modification of the cover sheet (11), a pushbutton switch (51) shown in FIG. 7 may include a reinforcing member (57), the upper surfaces of the reinforcing member (57) being formed in a dome-like configuration. By using a reinforcing member (57) in which their upper surfaces are formed in a dome-like configuration, it is possible to provide a pushbutton switch cover sheet (51) which is superior in operability. Further, as a modification of the pushbutton switch cover sheet (31), it is possible to form either the reinforcing members (37*a* or 37*b*) provided on the upper or lower surface of the thin metal plate (12) as upwardly convex reinforcing members (67*a*) as shown in FIG. 8, or downwardly convex reinforcing members (77*b*) as shown in FIG. 9. Further, it is also possible to deform both of the reinforcing members (37*a* and 37*b*) provided on the upper and lower sides of the thin metal plate (12). The upwardly convex reinforcing members (67*a*) are advantageous in that the individual depressing-operation portions (15) can be easily recognized. In the case of the downwardly convex reinforcing members (77*b*), the depressing force is easily concentrated, and the ON-load can be reduced.

Figure 10:
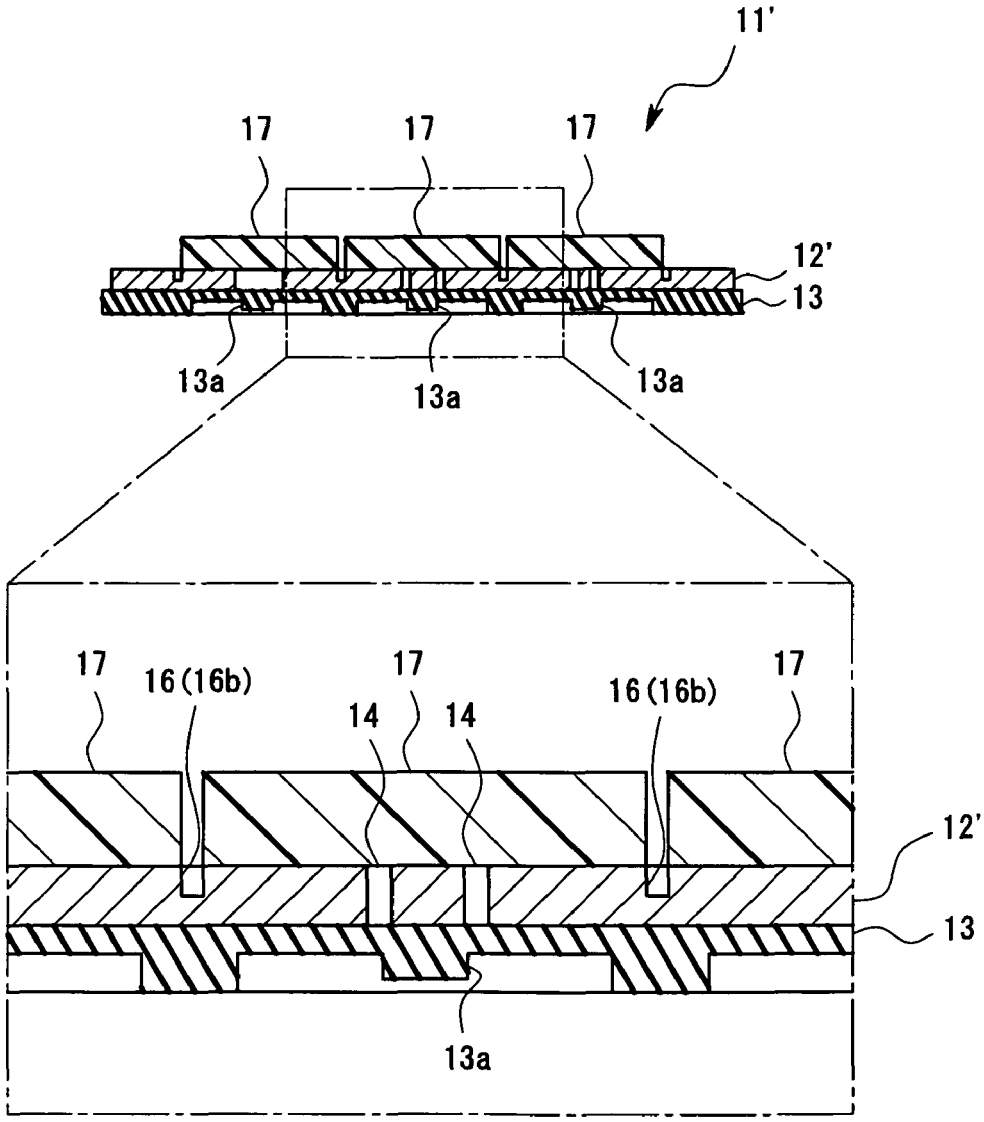
FIG. 10 is a sectional view, corresponding to FIG. 2, of a modification of the pushbutton switch cover sheet according to the first embodiment of the present invention.

Instead of being formed as the through-holes (16*a*) extending through the thin metal plate (12), the dividing sections (16) defining the depressing-operation portions (15) provided on the thin metal plate (12) may be formed as dividing grooves (16*b*) recessed on the upper side of the thin metal plate (12), or as dividing lines drawn in printing ink on the upper surface of the thin metal plate (12). However, the through-holes (16*a*) may lessen the input load when performing input operation. An example of the half-through dividing sections (16) as grooves (16*b*) is shown in FIG. 10.

Figure 11:
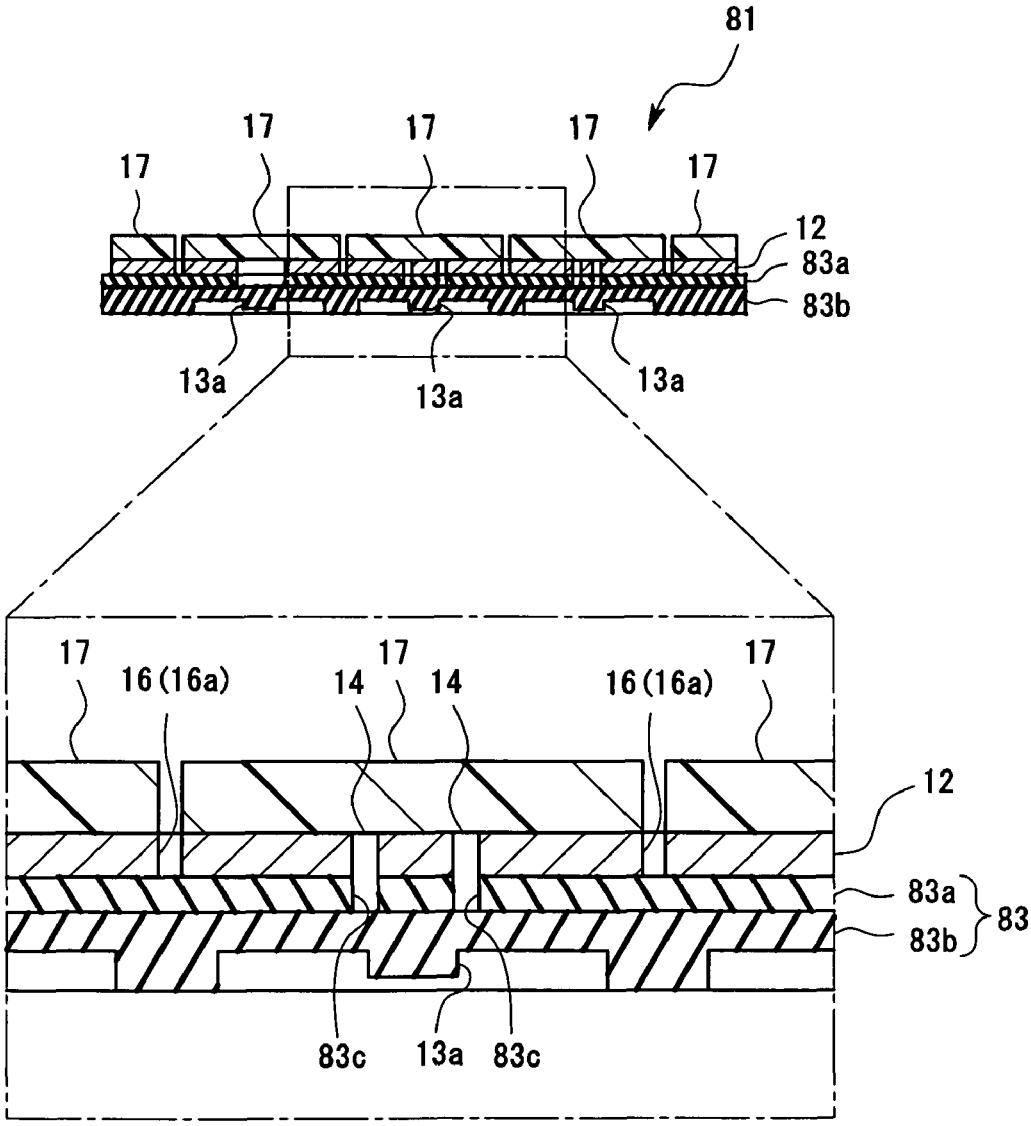
FIG. 11 is a sectional view, corresponding to FIG. 2, of still another modification of the pushbutton switch cover sheet according to the first embodiment of the present invention.
Figure 12:
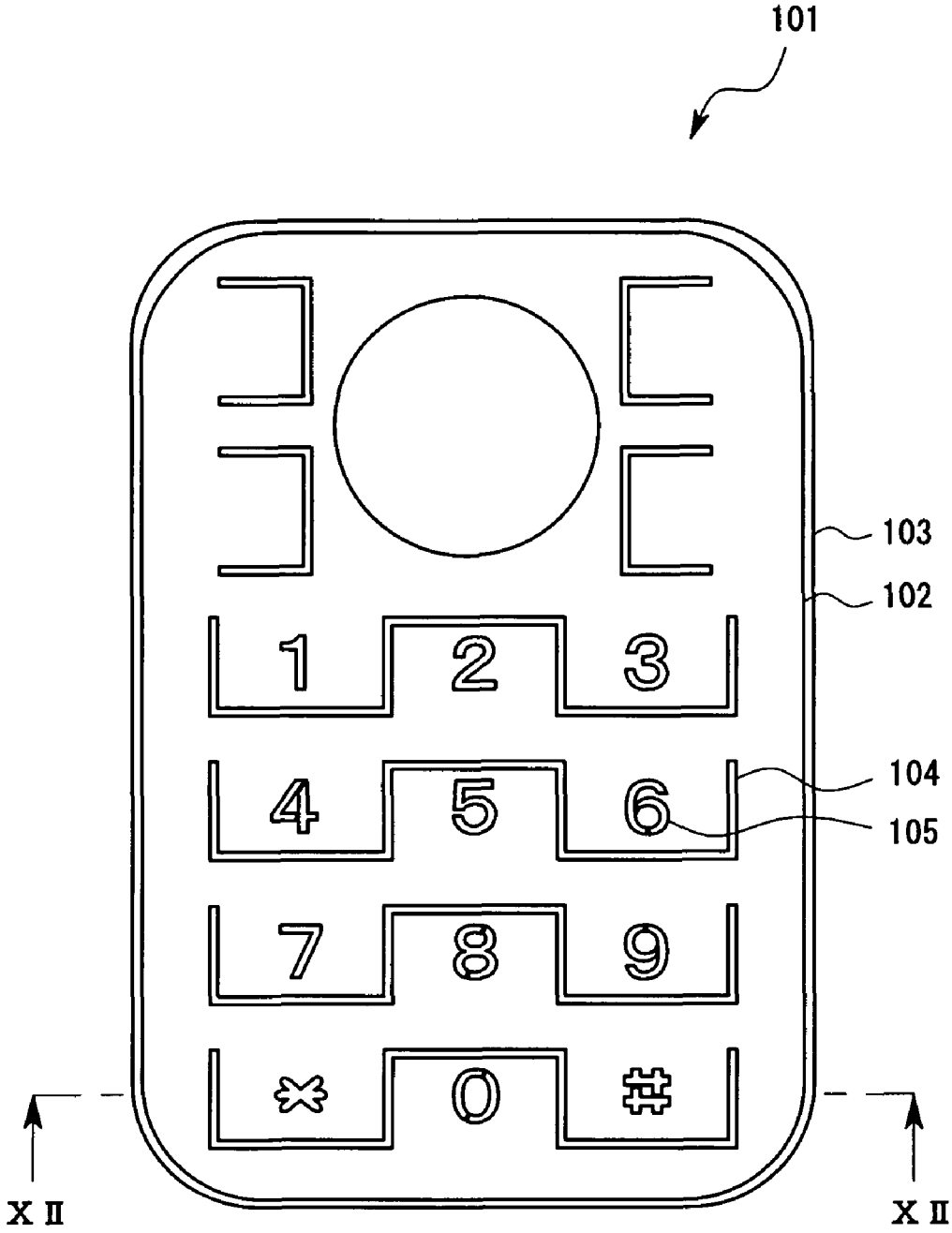
Fig.12 Related Art
FIG. 12 is a plan view of a pushbutton switch cover sheet with no reinforcing member.
Figure 13:
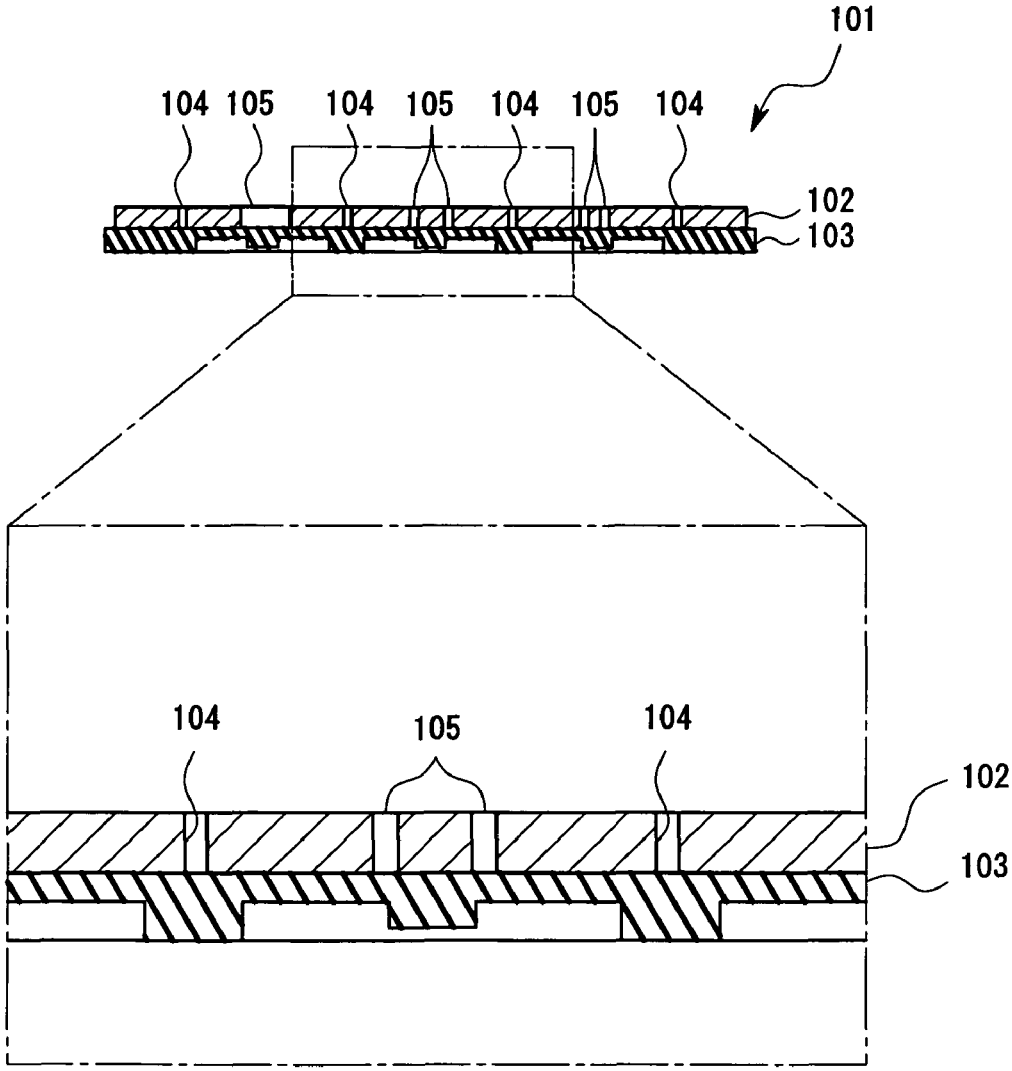
Fig.13 Related Art
FIG. 13 is a sectional view of the pushbutton switch cover sheet, taken along the line XII-XII of FIG. 12.

As shown in FIG. 11, in the case of an illumination type cover sheet (71), it is desirable to form a base sheet (83) in a double-layer construction composed of a light-tight upper layer (83*a*) and a light-transmitting lower layer (83*b*). The light-tight upper layer (83*a*) may be formed of a film-shaped resin. The light-tight upper layer (83*a*) being formed of a rubber-like elastic material is also within the scope of the invention. As shown in FIG. 11, the light-tight upper layer (83*a*) has through-holes (83*c*) corresponding to the display portions (14). The light-transmitting lower layer (83*b*) may be formed of a rubber-like elastic material, and has no such through-holes (83*c*) as formed in the upper layer (83*a*). Due to the use of the base sheet (83), constructed as described above, a pushbutton switch cover sheet (81) can prevent light leakage through the dividing holes (16*a*), making it possible to solely illuminate the display portions (14). Further, it is also possible to prevent intrusion of water from the display portions (14).

While in the above embodiments, the display portions (14) are provided on the thin metal plate (12), it is not always necessary to provide the display portions (14) on the thin metal plate (12). For example, it is also possible to form display portions (14) by performing printing on the reinforcing members (17) provided on the upper surface of the thin metal plate (12).

While the pushbutton switch cover sheets (11, 21, 41, 51, 61, 71, and 81) of the above-described embodiments are for use in any electronic device, by, for example, changing the positional relationship of the depressing-operation portions (15) with respect to the pushbutton switch cover sheets (11, 21, 41, 51, 61, 71, and 81).

EXAMPLES

Example 1

A pushbutton switch cover sheet (11) of the same construction as that according to the first embodiment of the present invention was manufactured. U-shaped dividing holes (16*a*) were formed in a thin metal plate (12) of a predetermined thickness formed of stainless steel, with the area of each of the tongue-shaped depressing-operation portions (15) surrounded by the dividing holes (16*a*) being 0.5 $cm^2$. Further, reinforcing members (17) of polycarbonate resin with a thickness of 0.2 mm were firmly attached by adhesive to the upper surface of the thin metal plate (12) so as to extend along and to be flush with the depressing-operation portions (15). The adhesive was caused to spread over the entire lower surfaces of the reinforcing members (17). Further, on the lower surface of the thin metal plate (12), there was provided a base sheet (13) which was formed of silicone rubber and whose thickness directly below the thin metal plate (12) was 0.2 mm. The thin metal plate (12) and the base sheet (13) were firmly attached to each other at positions spaced apart from the depressing-operation portions (15).

Table 1 shows the results of comparison in terms of the influence on the ON-load (the load when the contact is turned on through depression of the depressing-operation portion (15)), the reinforcing effect, and the ability to meet the requirement for a reduction in apparatus thickness depending upon the difference in the thickness of the reinforcing members (17) in the pushbutton switch cover sheet (11) thus produced.

TABLE 1

Relationship between the thickness of the reinforcing members and the ON-load, the reinforcing effect, and the ability to meet the requirement for a reduction in apparatus thickness

| | Specimen No. | | | | | |
|---|---|---|---|---|---|---|
| | S1 | S2 | S3 | R1 | R2 | R3 |
| Thickness of the reinforcing members (mm) | 0.2 | 1.0 | 2.0 | None | 0.1 | 2.5 |
| ON-load (N) | 2.67 | 2.71 | 3.02 | 2.67 | 2.67 | 3.45 |
| Reinforcing effect (*1) | ○ | ○ | ○ | x | x | ○ |
| Ability to meet the requirement for a reduction in apparatus thickness (*2) | ○ | ○ | ○ | ○ | ○ | x |

(*1) ○: The thin metal plate undergoes no deformation, such as bending or denting, even if depression is effected hard with a nail.
x: The thin metal plate undergoes deformation, such as bending or denting, if depression is effected hard with a nail.
(*2) ○: It is possible to meet the requirement for a reduction in apparatus thickness.
x: The pushbutton switch cover sheet is too thick to allow a reduction in apparatus thickness.

As shown in Table 1, in a specimen R2, in which the thickness of the reinforcing members (17) is 0.1 mm, the reinforcing members were incapable of protecting the thin metal plate (12), and denting occurred in the thin metal plate (12) when depressing operation was effected with a nail. In a specimen R3, in which the thickness of the reinforcing members is 3.0 mm, the load causing the switch to turn on at the time of depressing operation was rather large, and no satisfactory tactile feel was attained, with the operability being rather poor. Further, with this thickness, it is impossible to meet the requirement for a reduction in apparatus thickness. In specimens S1 through S3, in which the thickness of the reinforcing members (17) is 0.2 mm to 2.0 mm, no deformation, such as bending or denting, occurred even when depressing operation was effected with a nail, and it was possible to obtain a satisfactory tactile feel at the time of depressing operation.

Example 2

A pushbutton switch cover sheet (21) of the same construction as that according to the second embodiment of the present invention was produced. U-shaped dividing holes (16*a*) were formed in a thin metal plate (12) of a predetermined thickness formed of stainless steel, with the area of each of the tongue-shaped depressing-operation portions (51) surrounded by the dividing holes (16*a*) being 0.5 $cm^2$. Further, reinforcing members (27) of polycarbonate resin with a thickness of 0.2 mm were firmly attached by adhesive to the lower surface of the thin metal plate (12) so as to extend along and to be flush with the depressing-operation portions (15). The adhesive was caused to spread over the entire surfaces of the reinforcing members (27) bonded with the thin metal plate (12). Further, on the lower surfaces of the reinforcing members (27), there was provided a base sheet (13) which was formed of silicone rubber and whose thickness directly below the depressing-operation portions (15) was 0.2 mm. The reinforcing member (27) and the base sheet (13) were firmly attached to each other at positions spaced apart from the depressing-operation portions (15) which does not measure the ON-load.

Table 2 shows the results of comparison in terms of the influence on the ON-load, the reinforcing effect, and the ability to meet the requirement for a reduction in apparatus thickness depending upon the difference in the thickness of the reinforcing members (27) in the pushbutton switch cover sheet (21) thus produced.

TABLE 2

Relationship between the thickness of the reinforcing members and the ON-load, the reinforcing effect, and the ability to meet the requirement for a reduction in apparatus thickness

| | Specimen No. | | | | |
|---|---|---|---|---|---|
| | S4 | S5 | S6 | R4 | R5 |
| Thickness of the reinforcing members (mm) | 0.2 | 1.0 | 2.0 | 0.1 | 2.5 |
| ON-load (N) | 2.67 | 2.23 | 2.32 | 2.67 | 2.56 |
| Reinforcing effect (*1) | ○ | ○ | ○ | x | 46 |
| Ability to meet the requirement for a reduction in apparatus thickness (*2) | ○ | ○ | ○ | ○ | x |

(*1) ○: The thin metal plate undergoes no deformation, such as bending or denting, even if depression is effected hard with a nail.
x: The thin metal plate undergoes deformation, such as bending or denting, if depression is effected hard with a nail.
(*2) ○: It is possible to meet the requirement for a reduction in apparatus thickness.
x: The pushbutton switch cover sheet is too thick to allow a reduction in apparatus thickness.

Table 2 shows the differences in the ON-load, the reinforcing effect, and the ability to meet the requirement for a reduction in apparatus thickness depending upon the thickness of the reinforcing members in the second embodiment of the present invention. As shown in Table 2, in a specimen R4, in which the thickness of the reinforcing members (27) is 0.1 mm, the reinforcing members were incapable of protecting the thin metal plate (12), and bending occurred in the thin metal plate (12) when depressing operation was effected with a nail. In a specimen R5, in which the thickness of the reinforcing members (27) is 2.5 mm, it is impossible to meet the requirement for a reduction in apparatus thickness. Further, there is a fear of the reinforcing members (27) coming into contact and interfering with each other at the time of depressing operation. In Examples 4 through 6, in which the thickness of the reinforcing members is 0.2 mm to 2.0 mm, no deformation such as bending or denting occurs even if depressing operation is performed with a nail. Further, the load causing the switch to be turned on at the time of depressing operation is smaller than that in the case in which no reinforcing members (27) are provided, making it possible to obtain a satisfactory tactile feel.

The description of the present invention should not be construed restrictively; advantages, features, and uses of the present invention will become still more apparent from the following description given with reference to the accompanying drawings. Further, it should be understood that all appropriate modifications made without departing from the gist of the present invention are covered by the scope of the present invention. While various embodiments of the present invention are described, it should be understood that they have been presented by way of example only, and not as a limitation. Thus, the breadth and scope of the present invention should not be limited by any of the above-described exemplary embodiments.

What is claimed is:

1. A pushbutton switch cover sheet comprising:

a plurality of display portions;

a plurality of depressing-operation portions for effecting key input on the display portions, respectively;

a base sheet formed of an elastic material; and a thin metal plate provided on the base sheet, wherein a first reinforcing member formed of a polymeric material is provided for each depressing-operation portion so as to be adjacent to the thin metal plate in a direction of a thickness of the thin metal plate, the first reinforcing member includes a top surface and a bottom surface, the bottom surface contacts the thin metal plate, and the top surface is opposite to the bottom surface and defines an operation surface of the respective depressing-operation portion configured for actuation by a user, and wherein the display portion is coplanar with the metal plate.

2. A pushbutton switch cover sheet according to claim 1, wherein: the thin metal plate has dividing sections defining the depressing-operation portions; and the dividing sections are formed as U-shaped sections defining the depressing-operation portions so that swinging is allowed in the direction of the thickness of the thin metal plate and as dividing holes extending through the thin metal plate.

3. A pushbutton switch cover sheet according to claim 1, wherein: the thin metal plate has dividing sections defining the depressing-operation portions; and the dividing sections are formed as half-through dividing grooves extending through halfway of the thin metal plate.

4. A pushbutton switch cover sheet according to claim 1, wherein a thickness of the thin metal plate ranges from 50 μm to 2000 μm.

5. A pushbutton switch cover sheet according to claim 1, wherein a thickness of the thin metal plate ranges from 50 μm to 300 μm.

6. A pushbutton switch cover sheet according to claim 1, wherein the reinforcing member is transparent and is provided on an upper surface of the thin metal plate.

7. A pushbutton switch cover sheet according to claim 1, further comprising a second reinforcing member provided on a lower surface of the thin metal plate.

8. A pushbutton switch cover sheet according to claim 7, wherein configuration of the second reinforcing member is downwardly convex.

9. A pushbutton switch cover sheet according to claim 1, wherein configuration of the reinforcing member is upwardly convex.

10. A pushbutton switch cover sheet according to claim 1, wherein configuration of the reinforcing member is downwardly convex.

11. A pushbutton switch cover sheet according to claim 1, wherein a thickness of the reinforcing member ranges from 0.2 mm to 2.0 mm.

12. A pushbutton switch cover sheet according to claim 11, wherein the material is selected from polymethyl metacrylate resin, polycarbonate resin, or polystyrene resin.

13. A pushbutton switch cover sheet according to claim 1, wherein the material of the reinforcing member is to be one having a bending modulus of not less than 70 MPa and a Shore D hardness of not less than 40.

14. A pushbutton switch cover sheet according to claim 1, wherein the base sheet is in a double-layer construction composed of a light-tight upper layer and a light-transmitting lower layer, and wherein through-holes corresponding to the display portions are provided only in the light-tight upper layer.

15. A pushbutton switch cover sheet according to claim 1, wherein the display portion is embedded within the metal plate in the thickness direction.

16. A pushbutton switch cover sheet according to claim 1, wherein the display portion extends from the top to the bottom of the thin metal in the thickness direction.

17. A pushbutton switch cover sheet comprising:

a plurality of display portions;

a plurality of depressing-operation portions for effecting key input on the display portions, respectively;

a base sheet formed of an elastic material; and a thin metal plate provided on the base sheet, wherein a first reinforcing member formed of a polymeric material is provided for each depressing-operation portion so as to be adjacent to the thin metal plate in a direction of a thickness of the thin metal plate, the first reinforcing member includes a top surface and a bottom surface, the bottom surface contacts the thin metal plate, and the top surface is opposite to the bottom surface and defines an operation surface of the respective depressing-operation portion configured for actuation by a user, and wherein the bottom surface of the reinforcing member covers the plurality of display portions.

18. A pushbutton switch cover sheet comprising:

a plurality of display portions;

a plurality of depressing-operation portions for effecting key input on the display portions, respectively;

a base sheet formed of an elastic material; and a thin metal plate provided on the base sheet, wherein a first reinforcing member formed of a polymeric material is provided for each depressing-operation portion so as to be adjacent to the thin metal plate in a direction of a thickness of the thin metal plate, the first reinforcing member includes a top surface and a bottom surface, the bottom surface contacts the thin metal plate, and the top surface is opposite to the bottom surface and defines an operation surface of the respective depressing-operation portion configured for actuation by a user, wherein the base sheet is in a double-layer construction composed of a light-tight upper layer and a light-transmitting lower layer, and wherein through-holes corresponding to the display portions are provided only in the light-tight upper layer.

19. A pushbutton switch cover sheet according to claim 18, wherein the display portion is embedded within the metal plate in the thickness direction.

20. A pushbutton switch cover sheet according to claim 18, wherein the display portion extends from the top to the bottom of the thin metal in the thickness direction.

* * * * *